US005984673A

United States Patent [19]

Bossetti

[11] Patent Number: 5,984,673

[45] Date of Patent: Nov. 16, 1999

[54] KILN FOR BAKING CERAMIC MATERIALS

[75] Inventor: Renato Bossetti, Novara, Italy

[73] Assignee: Societa Impianti Termoelettrici Industriali, Italy

[21] Appl. No.: 09/019,376

[22] Filed: Feb. 5, 1998

[30] Foreign Application Priority Data

Mar. 17, 1997 [IT] Italy ..... MI97A0603

[51] Int. Cl.[6] ..... F27B 9/00; F27D 3/00

[52] U.S. Cl. ..... 432/121; 432/175; 431/171; 431/8; 239/505

[58] Field of Search ..... 432/121, 58, 72, 432/175, 171; 239/505, 587.1, 587.5; 431/158, 171, 8, 353; 110/264

[56] References Cited

U.S. PATENT DOCUMENTS

| | | | |
|---|---|---|---|
| 77,799 | 5/1868 | Browne | 239/505 |
| 1,654,403 | 12/1927 | Blake | 431/171 |
| 1,691,607 | 11/1928 | Kerr | 239/505 |
| 3,782,884 | 1/1974 | Shumaker . | |
| 4,229,163 | 10/1980 | Shinohara | 431/171 |
| 4,434,727 | 3/1984 | McCartney | 110/347 |
| 4,469,314 | 9/1984 | Takeuchi et al. | 432/175 |
| 4,493,640 | 1/1985 | Hanson | 432/72 |
| 4,627,814 | 12/1986 | Hattori et al. | 432/72 |
| 4,789,332 | 12/1988 | Ramsey et al. | 432/72 |
| 4,867,673 | 9/1989 | Harrigill | 431/171 |
| 5,494,529 | 2/1996 | Ciccarelli et al. | 239/587.5 |

FOREIGN PATENT DOCUMENTS

| | | |
|---|---|---|
| 537014 | 4/1955 | Belgium . |
| 537014 | 10/1955 | Belgium . |
| 811785 | 10/1936 | France . |
| 811785 | 4/1937 | France . |
| 2197456 | 8/1973 | France . |
| 2197456 | 3/1974 | France . |
| 2 134 330 | 1/1972 | Germany . |
| 3807 495 A1 | 3/1988 | Germany . |
| 3807495 | 9/1989 | Germany . |
| 296 06 706 U1 | 4/1996 | Germany . |
| 296 06 706 | 9/1996 | Germany . |
| 2 099 120 | 12/1981 | United Kingdom . |
| 2099120 | 12/1982 | United Kingdom . |

*Primary Examiner*—Philip H. Leung
*Assistant Examiner*—Jiping Lu
*Attorney, Agent, or Firm*—R. Neil Sudol; Henry D. Coleman

[57] ABSTRACT

A kiln for baking ceramic materials includes a plurality of burners arranged along the conveyor surface so as to heat the internal volume of the kiln. The kiln includes a deflector which is arranged along the path of the flame that exits from at least one of the burners, so that the path of the flame is diverted with respect to a straight free path, achieving diffusion of the flame in the intended direction.

15 Claims, 4 Drawing Sheets

KILN FOR BAKING CERAMIC MATERIALS

BACKGROUND OF THE INVENTION

1. Field of the Invention

The present invention relates to a kiln for baking ceramic materials, particularly a kiln of the type formed by a heated channel through which the ceramic materials to be baked are conveyed. These ceramic materials are conveyed inside the channel by means of conveyors. The conveyors can be constituted by carriages, which convey the ceramic material to be baked through the kiln, or preferably by a conveyor surface. The conveyor surface can be formed by a conveyor belt or preferably by a plurality of motorized rollers. Multiple burners are arranged along the heated channel so as to heat the internal volume of the kiln. The burners are generally arranged on the side walls of the channel that forms the kiln, both above and below the conveyor surface formed by the motorized rollers.

2. Description of the Prior Art

The burners used are of various kinds according to the requirements and in particular they have a radiant, convective, high- or low-speed flame. The general purpose is to achieve optimum transfer of the heat generated by the burner, so as to provide an environment which is as uniform as possible around the parts to be baked, without discontinuities with excessively hot or excessively cold regions or points.

It has been observed that burners with a high gas stream speed generally allow better mixing of the atmosphere inside the kiln, allowing to improve the uniformity of the temperature conditions even with kilns in which the channel has a particularly wide transverse cross-section. In this manner, the kinetic energy generated by the stream of burner gas in fact entrains more or less significant masses of the atmosphere inside the kiln, so as to perform a mixing action which strikes the product to be baked with significant speeds. The expression "burners with a high gas stream speed" is used with reference to burners with outlet speeds of more than 40 m/s, preferably more than 50 m/s, and up to as much as 200 m/s.

The above is the main field of industrial utilization of the invention but is not a limitation, since the kiln according to the invention can be used in any other equivalent field, as claimed.

Devices as described above are known but have some drawbacks. In particular, in the immediate vicinity of the outlet of the burners there is no mixing of the atmosphere inside the kiln, and accordingly there are considerable temperature differences. In other words, while the central region of the channel is heated adequately, with a sufficiently uniform temperature, the regions near the walls, where the burners are installed, have a high temperature gradient, generally with temperatures which are significantly colder than those of the central region.

This difference becomes increasingly significant as the outlet speed of the burnt gases rises and, of course, as the transverse cross-section of the kiln increases. Since burners with a high gas outlet speed are generally used with kilns which have a considerable transverse width, in such conditions the kiln cannot be utilized adequately, because only the central part of the roller conveyor surface can be loaded, while the lateral parts, near the walls, must be left free from ceramic material to be baked, in order to prevent the high temperature gradient that occurs in these regions from causing defective production, which must later be rejected.

In practice, therefore, the use of kilns which have a considerable transverse width to increase production cannot achieve the intended purposes.

GB 2 099 120 discloses a kiln in which the outlet of the burners is not straight, but comprises a bent end, so that the stream of burner gas is not directed perpendicularly to the burner supporting wall, rather it is directed with an angle of about 40° with respect to this wall. However, also in this case, the above problems are not solved. In fact, the hot gas stream, even if inclined of 40°, cannot be opened to a large diffusion angle and always gives rise to the above temperature differences, inside the kiln. Furthermore, it is impossible to adjust local temperature problems.

FR 811 785 discloses a kiln, that, in correspondence with the burners is so shaped that the hot gas stream is redirected also tangentially to the wall of the kiln. However this solution, developed for metallurgical kilns is not suitable for kilns for firing ceramic material. In fact, in our case, the material to be fired is much more sensitive to temperature differences. Furthermore this solution cannot be used with the above identified burners with a high gas stream speed. Finally it is impossible to carry out any adjustment.

DE 296 06 706 U1 discloses a kiln heated with burners operating with the so called Venturi effect. The outlet flow of these burners cannot be opened to a large diffusion angle. Furthermore the burners are considerably expensive.

DE 2 134 330 discloses a kiln, in which the end of the burners is so shaped that the hot gas stream is redirected tangentially to the wall of the kiln. However, the above problems cannot be solved. In fact, the hot gas stream, even if redirected tangentially, cannot be opened to a large diffusion angle and always gives rise to the above temperature differences, inside the kiln. Furthermore, it is impossible to adjust local temperature problems.

Belgian patent 537 014 discloses a kiln in which, in the fixed structure of the kiln, there is arranged a diffusion element for each burner. However, also in this case, it is impossible to adjust the firing effect of the burners according to the local requirements. Particularly it is impossible to test various heating conditions in a process of trial-error-correction.

U.S. Pat. No. 3,782,884 discloses details of a burner, but nothing that can be helpful to solve the above problems.

DE 3 807 495 and FR 2 197 456 disclose a kiln in which the hot gas stream cannot be opened to a large diffusion angle and gives rise to the above temperature differences. Also in this case, it is impossible to adjust the firing effect of the burners according to the local requirements. Particularly it is impossible to test various heating conditions in a process of trial-error-correction.

SUMMARY OF THE INVENTION

The aim of the present invention is therefore to overcome the above described drawbacks with a kiln for baking ceramic materials which includes: a channel heated by means of a plurality of burners arranged along the channel, so as to heat the internal volume of the kiln; and conveyor devices for conveying the ceramic materials through the channel; characterized in that it includes a deflector which is arranged along the path of the flame that exits from at least one of the burners, so that the path of the flame is diverted with respect to a straight free path, achieving diffusion of the flame in the intended direction; an orientation of said deflector being adjustable.

The present invention will become apparent by reference to the drawings, enclosed by way of non-limitative example, of two embodiments of the invention, wherein:

DESCRIPTION OF THE PREFERRED EMBODIMENTS OF THE INVENTION

Figure 1:
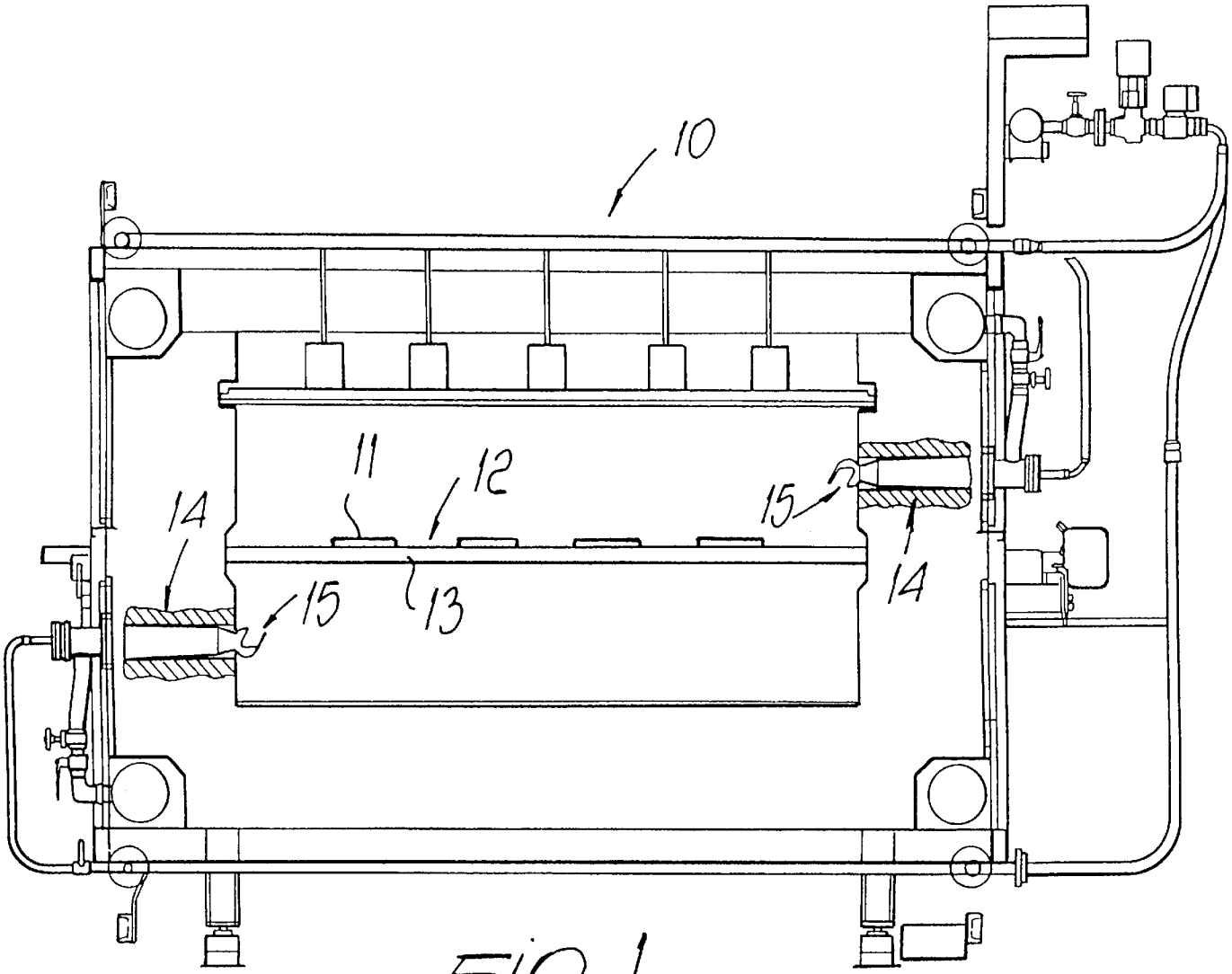
FIG. 1 is a partially sectional transverse view of a first embodiment of the kiln according to the invention.

With reference to FIGS. 1 to 6, the invention relates to a kiln 10 for baking ceramic materials which are constituted in particular by the tiles 11. The kiln 10 includes a conveyor surface 12 for the ceramic materials, which is formed by a plurality of rollers 13 arranged transversely with respect to the direction of the channel of the kiln.

The burners 14 are arranged both above and below the ceramic material conveyor surface. Each burner includes a deflector 15 which is arranged along the path of the flame, so that the path of the flame is deflected with respect to a straight free path, achieving a diffusion of the flame in the intended direction. The orientation of the deflector 15 is adjustable from the outside of the kiln.

The deflector 15 is preferably made of silicon carbide, so as to withstand the extremely high temperatures which occur in actual operating conditions. More preferably, the silicon carbide is of the nitrided or resilicated type.

The deflector 15 includes a body 17 which is arranged at an angle with respect to the direction that the flame would assume if it had a free path. In practice, the free path would coincide with the axis of the burner. In the embodiment shown in the drawings, the inclined body 17 is formed by an inclined plate made of silicon carbide.

Figure 5:
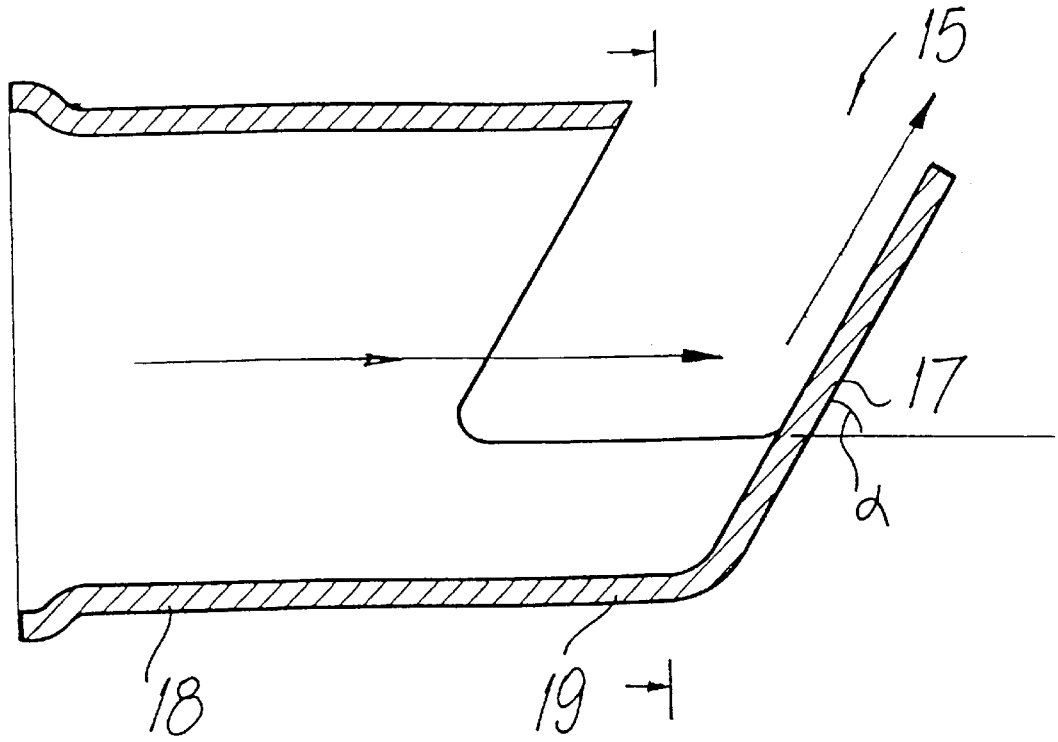
FIG. 5 is a sectional transverse view of a detail of the kiln of FIG. 4.

This inclination, represented by the angle a particularly in FIG. 5, is between 90° and 30°, preferably between 80° and 45°.

The inclined body 17 is connected to the burner 14 by means of a hollow body 18 through which the flame passes. In the embodiments shown in the drawings, the hollow body has a cylindrical shape and acts as support for the inclined body 17.

The deflector has lateral openings so as to allow lateral diffusion of the flame. In practice, this diffusion is performed over an angle, represented by $\beta$ with particular reference to FIG. 6, which is preferably greater than 60° and more preferably greater than 120°.

Figure 4:
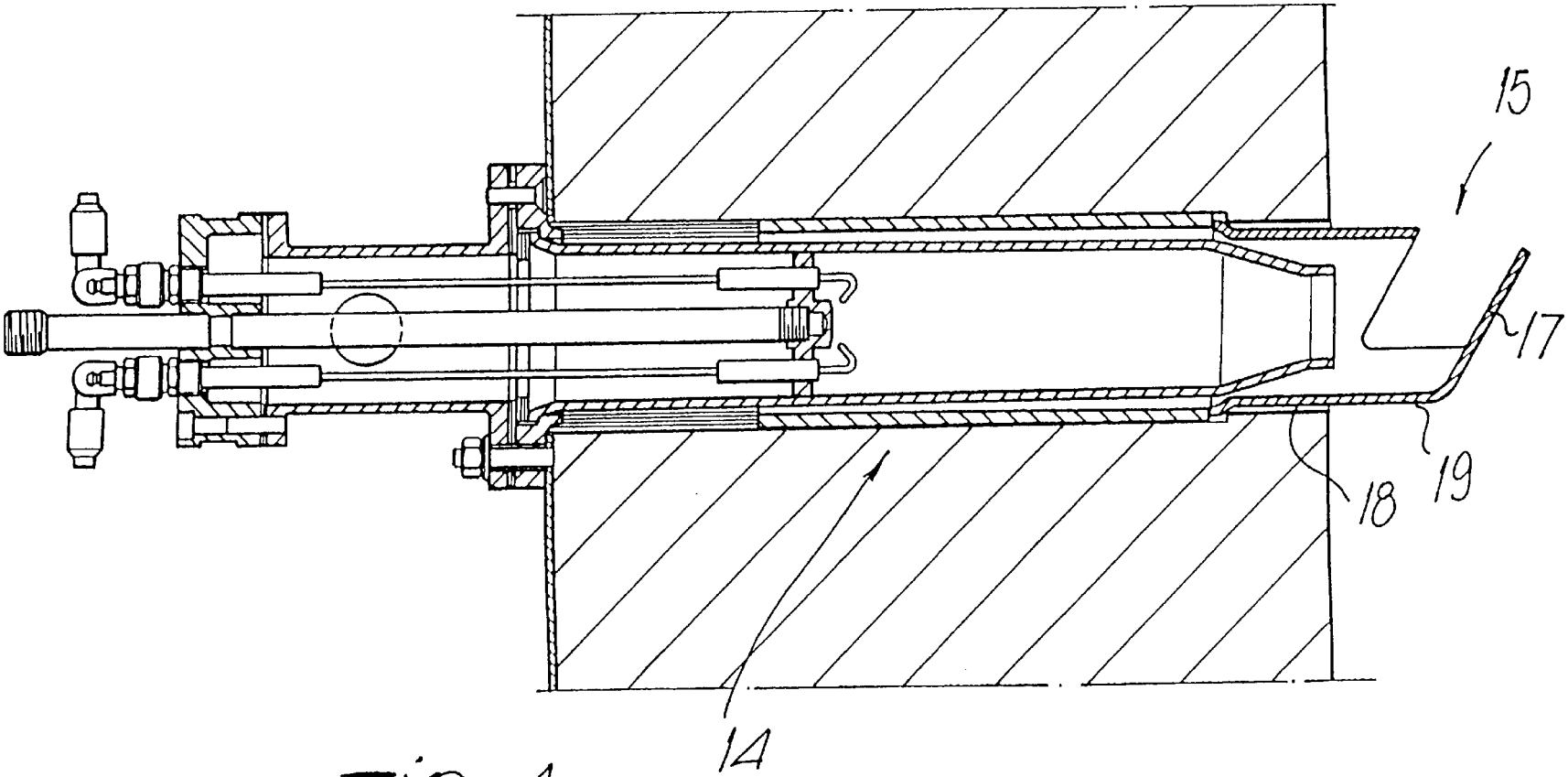
FIG. 4 is a transverse view of a detail of a second embodiment of the kiln according to the invention.
Figure 6:
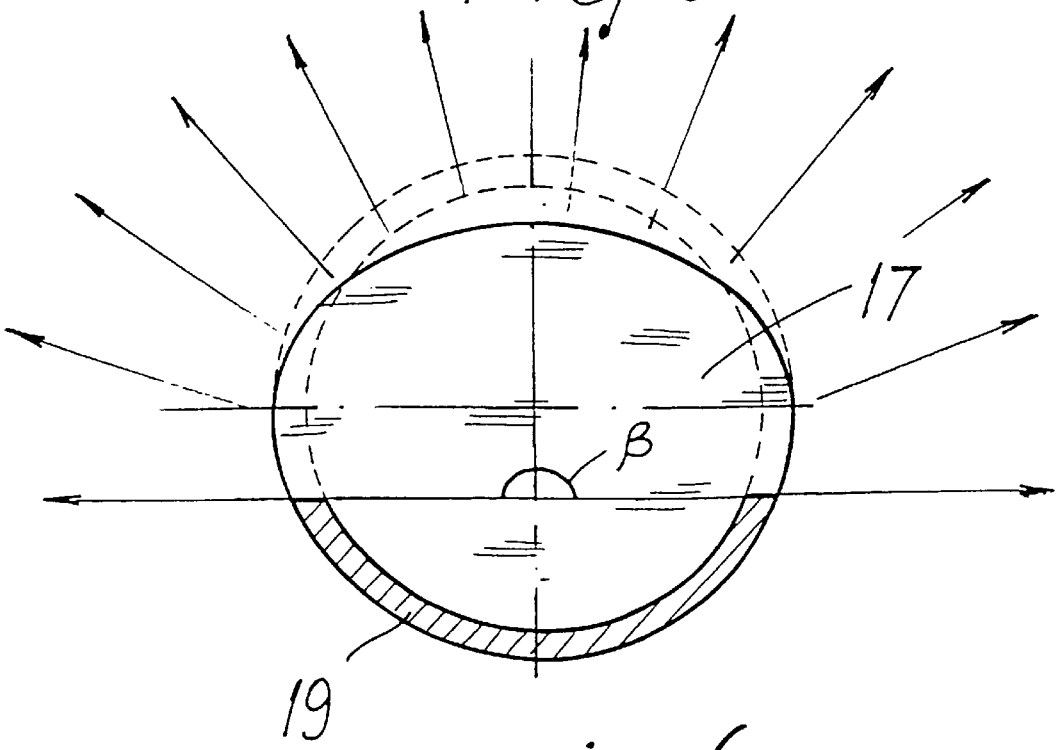
FIG. 6 is a partially sectional side view of the kiln of FIG. 4.

With particular reference to FIGS. 4 to 6, and to the second embodiment of the invention, the deflector 15 can rotate with respect to the burner 14 so that its orientation can be adjusted.

Figure 2:
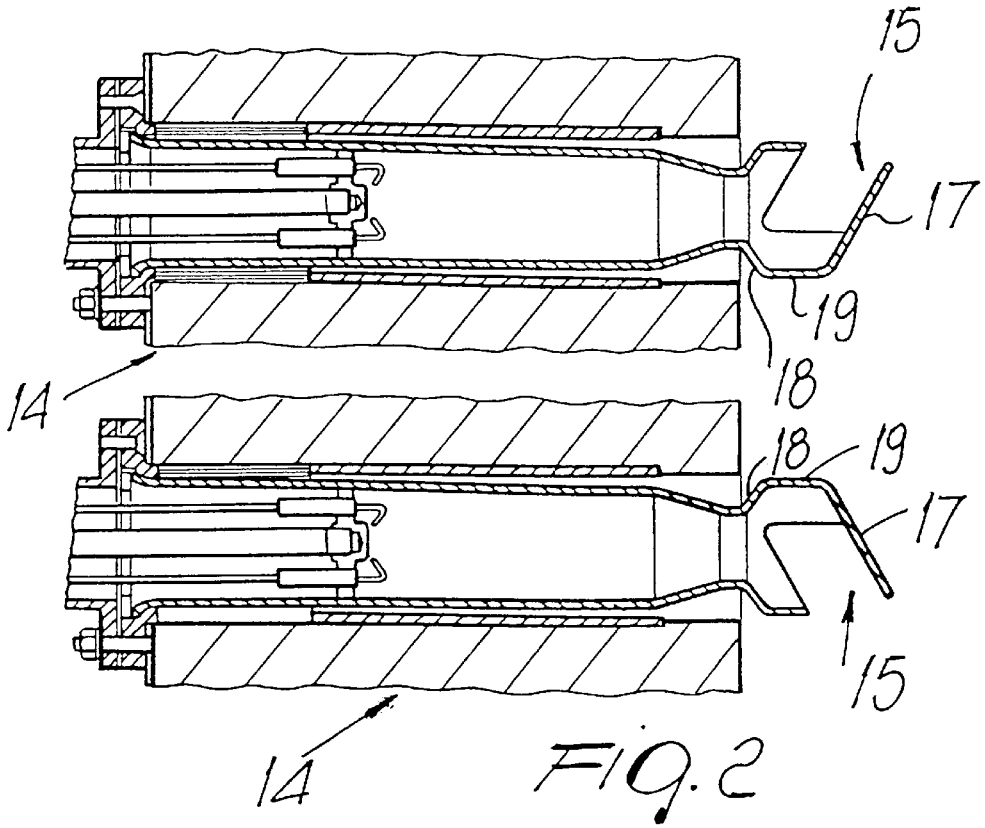
FIG. 2 is a partially sectional transverse view of an enlarged detail of the kiln of FIG. 1.
Figure 3:
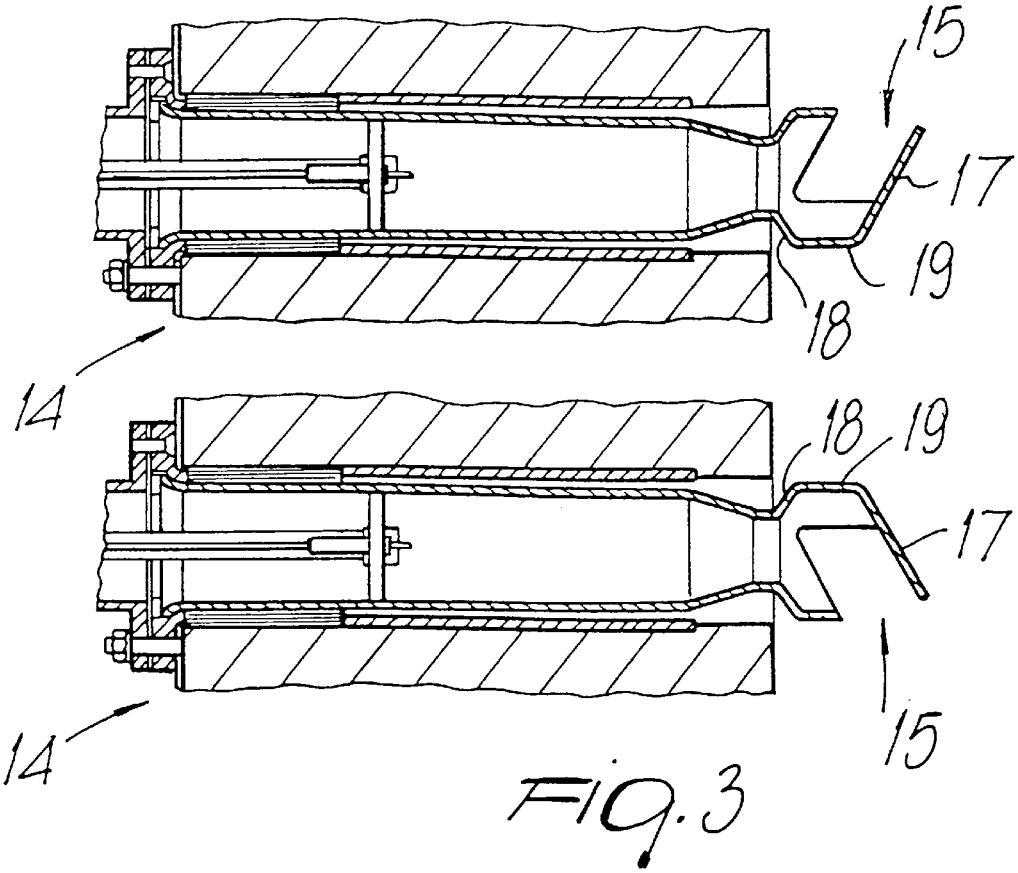
FIG. 3 is a partially sectional plan view of an enlarged detail of the kiln of FIG. 1.

As an alternative, with particular reference to FIGS. 1 to 3, the deflector 15 is monolithic with the burner 14. In this case the orientation of the deflector 15 can be adjusted simply turning the whole burner inside its seat.

The embodiment in which the deflector 15 can rotate with respect to the burner is preferred, since it can be produced with significantly lower production costs because it is possible to use otherwise standard burners. With reference to FIGS. 1 to 6, the deflector 15 includes a lateral part 19, for limiting the diffusion of the flame, so as to protect the opposite side of the kiln 10. The lateral part 19 constitutes a sort of side wall which supports the inclined body 17 and therefore acts both as support and as protection for the opposite part of the kiln.

With particular reference to FIG. 2, the upper part of the figure shows a burner in which the stream is directed upward, so that the lateral part 19 protects the lower part of the kiln, whilst the lower part of FIG. 2 shows a burner in which the stream is directed downward, so that the lateral part 19 protects the upper part of the kiln.

With particular reference to FIG. 3, the upper part of the figure shows a burner in which the stream is directed toward the inlet of the kiln, whilst the lower part shows a burner in which the stream is directed toward the outlet of the kiln.

The deflector 15 can have devices for making the flame rotate; such devices are not shown in the figures but can be provided by slightly tilting the inclined body 17 about an angle which is perpendicular to the angle $\alpha$, shown with particularly reference to FIG. 5.

Preferably a dimension of the deflector 15 is smaller than a seat of a corresponding burner. Particularly in this way the deflector 15 can be extracted from the kiln together with the corresponding burner. Of course, as reported in the drawing the seat of the burner is generally cylindrical and so the relevant dimension is the diameter of this cylindrical seat. In other words, for example, the deflector 15 can be extracted from the kiln, together with the burner, if a dimension of the deflector is smaller than the diameter of the seat of the burner.

The invention has several advantages, since first of all the deflector 15 allows to direct the stream of the flame in the intended direction, even so as to strike the walls of the kiln, thus allowing to heat as uniformly as possible even the regions which previously were difficult to regulate.

Another advantage of the invention is that it allows to adjust the deflector 15 in all intended directions, as shown in particular by FIGS. 2 and 3, so as to allow a particularly flexible adjustment according to the requirements. Particularly important is the possibility to easily carry out a trial-error-correction process. In fact the position of each deflector 15 can be easily adjusted without stopping the kiln. It is enough to turn the relevant burner inside its seat or to extract the burner and turn the position of the deflector 15 on the burner. So with simple means it is possible to test unexpensively many possibility for each particular ceramic material to be fired, until the best result is accomplished.

Another advantage is that it allows to divide the heat stream of the burner 14 into two parts, one of which can be directed toward the center, so as to generate vortices, whilst the other one heats the section of the kiln to a decreasing extent from the wall toward the center.

Another advantage is that it allows adjustment both above and below the rollers, according to the requirements, whilst the part of the stream that affects the wall can be orientated so as to regulate the volume above the ceramic material to be baked.

Another advantage is constituted by the fact that operation is constant, regardless of the flow of fuel fed to the burners. If the burners are fed scarcely, the action is less intense; if the burners are fed more, the action is greater, but the action of the deflector continues nonetheless.

Another advantage of the invention is that it can be installed where and if required, for example in the preheating section of the kiln or in the baking section, in amounts which depend on the extent of the problem and if the problem exists.

Another advantage is constituted by the fact that the stream used to heat the wall can be adjusted by regulating the air and gas of the burner or by orientating the deflector 15.

Another advantage is constituted by the fact that the temperature adjustment system commonly used in kilns does not need modifications to its simplicity and effectiveness, since the described system according to the invention is applied to each individual burner 14, thus avoiding the complexities of alternative solutions such as the pulsar system.

Another advantage is constituted by the fact that this device can be used not only to heat the ceramic material to be baked near the walls but also for cooling; that is to say, it can be applied not only to convey hot fumes but also to convey cold air. This last action can be useful in so-called "monoporous" production or in the production of particular enamels.

Another advantage is that when a dimension of the deflector 15 is smaller than a seat of a corresponding burner, it is possible to use the trial and error process also in relation to the position of the burners provided with deflector 15 with respect to the burners without deflector 15. In other words it is possible to use only a limited number of burners provided with a deflector 15, and a number of burners without any deflector, then assess the optimum working conditions actually testing them, changing the position of the burners with deflector 15 with respect to the other burners.

It has been observed that the invention allows to achieve the above described aim and advantages, since the ceramic material, particularly ceramic tiles, that leaves the kiln has shown, by virtue of the so-called "buller" measurement, a maximum temperature difference of only 1.5–2° C. In other words, the temperature discontinuities inside the kiln are very limited, since they are below 2° C. It has also been observed that the flatness of ceramic tiles is maintained perfectly, despite using a general combustion system of the conventional type with fixed or modulated air, with the same volumes involved.

All of the above has thus been achieved with great simplicity of application, reliability of the result, and independence from everything, with great operating flexibility.

What is claimed is:

1. Kiln for baking ceramic materials, comprising:

a channel heated by means of a plurality of burners arranged along said channel, so as to heat an internal volume of said kiln, said kiln being provided with at least one hole receiving a respective one of said burners;

conveyor devices for conveying said ceramic materials through said channel;

a deflector which is arranged along a path of a flame that exits from said one of said burners, so that the path of said flame is diverted with respect to a straight free path, achieving diffusion of said flame in an intended direction; and a support body arranged inside said hole and connected to said deflector for supporting same so that an orientation of said deflector is adjustable from outside said kiln, said deflector being smaller than said hole, thereby enabling an extraction of said deflector from said kiln via said hole.

2. Kiln according to claim 1, wherein said deflector is made of silicon carbide.

3. Kiln according to claim 2, wherein said silicon carbide is nitrided or resilicated.

4. Kiln according to claim 1, wherein said deflector comprises a body which is arranged at an angle with respect to said free path.

5. Kiln according to claim 4, wherein the angle of said inclined body with respect to said free path is between 90° and 30° and preferably between 80° and 45°.

6. Kiln according to claim 4, wherein said inclined body is formed by an inclined plate.

7. Kiln according to claim 4, wherein said inclined body is connected to said burner by a hollow body through which said flame passes.

8. Kiln according to claim 1, wherein said diffusion of said flame is performed over an angle of more than 60°, preferably more than 120°.

9. Kiln according to claim 1, wherein said deflector can rotate with respect to said burner so as to allow to adjust its orientation.

10. Kiln according to claim 1, wherein said deflector is monolithic with said burner.

11. Kiln according to claim 1, wherein said deflector comprises a lateral part for limiting said diffusion of said flame, so as to protect an opposite side of said kiln.

12. Kiln according to claim 1, wherein said deflector has a device for making said flame rotate.

13. Kiln according to claim 1, wherein said burners have a gas outlet speed of more than 40 m/s.

14. Kiln according to claim 1, wherein said conveyor devices are formed by a plurality of carriages or by a conveyor surface for the ceramic materials to be baked.

15. Kiln according to claim 14, wherein said conveyor surface is formed by a plurality of motorized rollers.

* * * * *

UNITED STATES PATENT AND TRADEMARK OFFICE

CERTIFICATE OF CORRECTION

PATENT NO. : 5,984,673

DATED : November 16, 1999

INVENTOR(S) : Renato Bossetti

It is certified that error appears in the above-identified patent and that said Letters Patent is hereby corrected as shown below:

On the title page, Item [73]

In the Assignee: change "Societa Impianti Termoelettrici Industriali" to --S.I.T.I. S.p.A. Società Impianti Termoelettrici Industriali--

Signed and Sealed this

Fifth Day of December, 2000

*Attest:*

*Attesting Officer*

Q. TODD DICKINSON

*Director of Patents and Trademarks*